US005704171A

United States Patent [19]

Ruff et al.

[11] Patent Number: 5,704,171

[45] Date of Patent: Jan. 6, 1998

[54] DOOR FRAME INSTALLING FIXTURE

[75] Inventors: Robert O. Ruff, Cincinnati; Donald L. King, Loveland, both of Ohio

[73] Assignee: Ingersoll-Rand Co., Phillipsburg, N.J.

[21] Appl. No.: 334,246

[22] Filed: Nov. 4, 1994

[51] Int. Cl.[6] ..... E04B 1/00

[52] U.S. Cl. ..... 52/127.2; 52/146; 248/351

[58] Field of Search ..... 52/127.2, 127.8, 52/146, 149, 150, 151, 217, 204.56; 248/351

[56] References Cited

U.S. PATENT DOCUMENTS

| | | |
|---|---|---|
| 2,914,813 | 12/1959 | Christian et al. . |
| 2,914,814 | 12/1959 | Christian et al. . |
| 3,027,686 | 4/1962 | Oates . |
| 3,166,164 | 1/1965 | Daniels . |
| 3,648,421 | 3/1972 | Bjork . |
| 3,914,812 | 10/1975 | Christian et al. . |
| 4,048,771 | 9/1977 | Thistlethwaite . |
| 4,304,078 | 12/1981 | Meriwether, Jr. . |
| 5,025,607 | 6/1991 | Green et al. . |
| 5,253,839 | 10/1993 | McClure . |

OTHER PUBLICATIONS

"Marbe Set Hollow Metal Door Frame Setting System", D D MFG., Inc. Quality Manufacturing & Design, 3 pages.

*Primary Examiner*—Carl D. Friedman
*Assistant Examiner*—Creighton Smith
*Attorney, Agent, or Firm*—Steven J. Rosen

[57] ABSTRACT

A door frame fixturing and bracing apparatus for fixturing and bracing a metallic door frame having two opposed jambs and a connecting header above a floor and typically between masonry walls. The apparatus includes a single fixturing frame having an upper member, a lower member, and at least one brace member disposed between a pair of opposed side members, the members being connected together to form an integral rectangular fixturing frame generally conforming to at least a width wise extending interior portion of the metallic door frame between its jambs. Legs are pivotally connected to the side members for swinging movement which is lateral to the plane of the door frame. A fastening means for temporarily securing the fixturing frame to the door frame includes a screw means for engaging apertures in the door jambs. An open ended clamp pivotably mounted to each of the side members provides a means for adjusting a length of each of the legs between the side members and the floor to locate the legs at a required inclination with respect to the floor. A flat support base is pivotably attached to a bottom end of each of the legs.

10 Claims, 3 Drawing Sheets

DOOR FRAME INSTALLING FIXTURE

BACKGROUND OF THE INVENTION

1. Field of the Invention

The present invention pertains to adjustable door frame fixtures for supporting or bracing door frames during installation. In particular, it pertains to adjustable door frame fixtures for temporarily supporting metal door frames in proper alignment during installation.

2. Description of Related Art

During building construction, it is often necessary to fixture a door frame to temporarily support the door frame prior to the erection or completion of adjacent walls. This is desirable in order that the frame be plumbed and aligned to insure proper door operation, specially those made of metal, in commercial buildings and, more particularly, for masonry construction where there is nothing to support the door frame until the adjoining masonry wall is formed thereabout. Several temporary support or braces have been developed in the past few years to accomplish this purpose.

While the temporary door frame supports of the prior art are definitely better than supporting the door frame with lumber braces, they have not been completely satisfactory for various reasons. Many of them are complicated, costly, and cumbersome to use and susceptible to damage or the loss of parts. Examples of such supports or braces are disclosed in U.S. Pat. No. 4,304,078 entitled "Adjustable Support Apparatus", by Irvin F. Meriwether, Jr. and U.S. Pat. No. 4,048,771 entitled "Door Framing Fixture and Method", by Mark K. Thistlethwaite.

Metal door frames, typically used for fire doors and standard doors in masonry walls, such as those used in multi-story buildings have elongate channels made from sheet metal. There are hollow regions defined by the channels which must be filled with grout or other filler material to set the door frame in place. It is important that the door frames do not buckle or otherwise deform when the hollow regions and the gaps are filled with grout. This is particularly important in the case of fire doors, since building regulations prescribe close tolerances between the door frames and the fire doors and, as a consequence, the fire doors will not fit the openings properly if the door frames are even slightly out of square.

In order to minimize buckling or other deformation, it is standard practice to brace the door frames while the grout is being poured into the hollow regions and the gaps and during the time it takes for the grout to substantially set. Bracing members should allow easy access through the frames while the grout sets, which usually requires at least several hours to set sufficiently, to allow the bracing members to be removed. The support and bracing door frame fixture should be reusable to decrease the cost of the work. Such a door frame support and brace device is disclosed in U.S. Pat. No. 5,253,839 entitled "Brace", by Alex R. McClure, its a device to brace a door frame formed from elongate channel members to prevent the sides of the door frame buckling or otherwise deforming when grout or other filler material is used to fill a hollow region defined by the channel members and/or a gap between the door frame and an adjacent wall. This device has a pair of elongate support members, each one of which is constructed to be positioned along and contact a side of the door frame, substantially along the frame's length. The support members are coupled together in a manner so as to allow for movement between a retracted position and an expanded position of the support members and, the device includes a locking apparatus for selectively locking the support members in the expanded position with the contact surfaces in contact with the opposed sides of the door frame to brace the sides of the door frame.

However, such a device is costly and complicated having many parts which are easily misplaced or lost on a cluttered and busy job or construction site. Access to both sides of the door frame is not always available or easy. This makes the assembly and disassembly of the device in U.S. Pat. No. 5,253,839 less attractive. The present invention has been developed to provide an uncomplicated, easy to use, versatile, and inexpensive door frame fixturing and bracing apparatus.

SUMMARY OF THE INVENTION

The present invention provides a door frame fixturing and bracing apparatus for fixturing and bracing a metallic door frame having two opposed jambs and, a connecting header above a floor and typically between masonry walls. The apparatus includes a single fixturing frame having an upper member, a lower member, and a pair of opposed side members, the members being connected together to form an integral rectangular fixturing frame generally conforming to at least a width wise extending interior portion of the metallic door frame between its jambs. Preferably, the integral rectangular fixture has an exterior periphery that defines the desired interior alignment of the metallic frame. The apparatus further includes at least one brace member extending between the opposed side members, legs, each of which is pivotally connected to one of the side members for swinging movement which is lateral to the plane of the door frame and, a fastening means for temporarily securing the fixturing frame to the door frame. The fastening means may comprise a screw means for engaging apertures in the door jambs. The apparatus further includes a leg length adjusting means for adjusting a length of each of the legs between the side members and the floor to locate the legs at a required inclination with respect to the floor. In one embodiment, the leg length adjusting means is an open ended clamp pivotably mounted to each of the side members. In yet another embodiment, the legs are constructed of lengths of preferably annular conduit. A more specific embodiment provides a flat support base pivotably attached to a bottom end of each of the legs such that the support base is operable to lie generally flat on the floor and is secured in place by weights such as masonry blocks. Another embodiment of the present invention provides a height adjustment means for adjusting the height of the fixturing frame above the floor and which includes a threaded shaft, which may be a screw, disposed through and in threading engagement with a threaded aperture in the lower member.

ADVANTAGES

Among the advantages provided by the present invention is an easy to use, inexpensive, and uncomplicated fixturing assembly that is particularly suited for use on construction sites. The legs that are often broken are easily replaced with readily available material found on job or construction sites. The assembly is easy to assemble, connect to the door frame, and to adjust the position of the door. The fixturing assembly of present invention is easier to use, repair, and adjust than similar devices found in the prior art.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
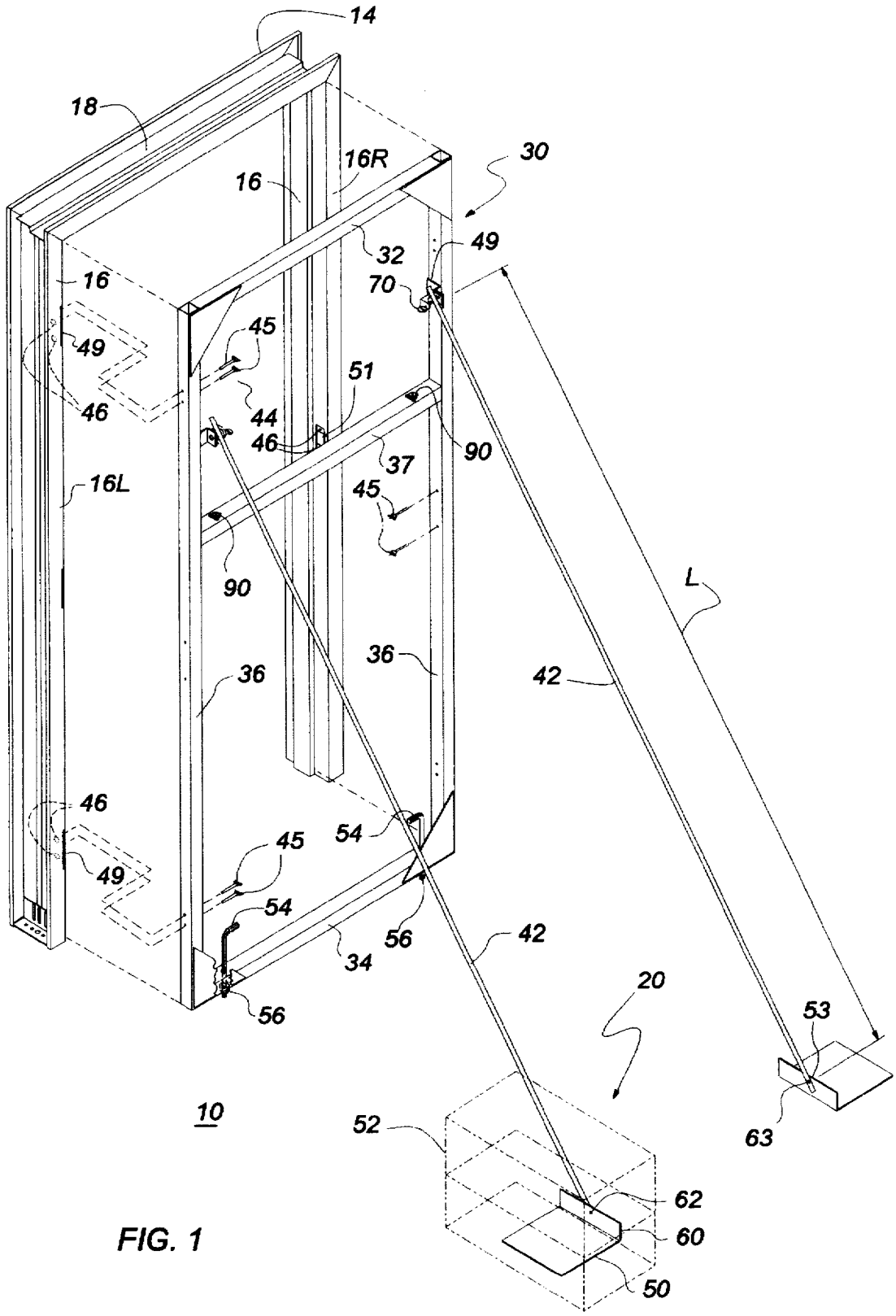
FIG. 1 is a perspective view illustrating an exemplary embodiment of a metal door fixturing assembly in accordance with the present invention.
Figure 2:
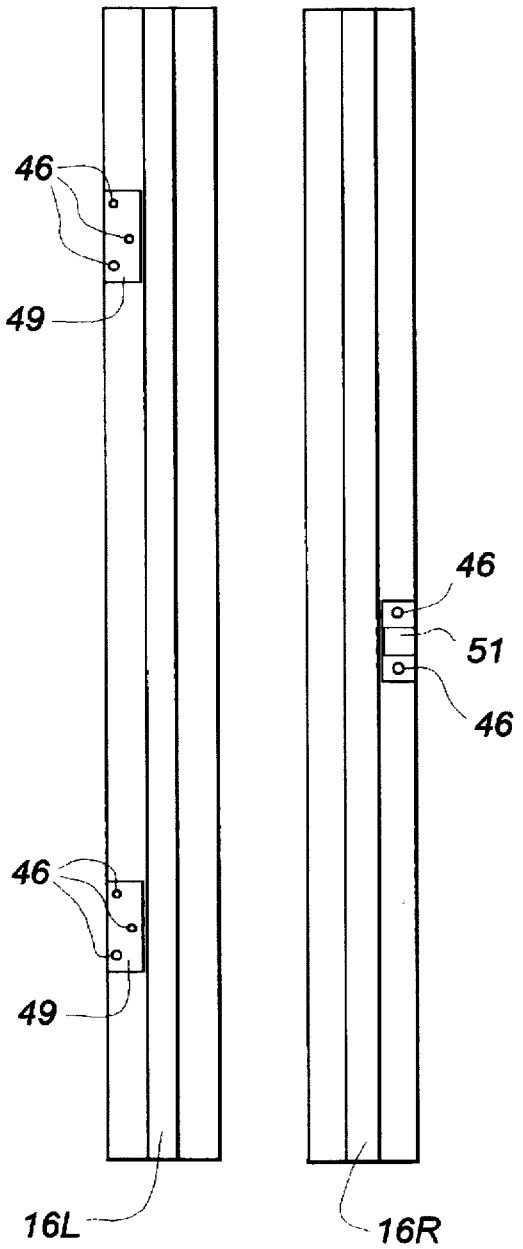
FIG. 2 is a side view through 2—2 in FIG. 1.

Illustrated in FIGS. 1 and 2 is a fixturing and bracing apparatus 10 for fixturing and bracing a metallic door frame 14 which a has a pair of opposed door jambs 16, a right hand door jamb 16R and a left hand door jamb 16L, and a connecting header 18 resting on a floor 20 and typically between masonry walls (not shown) that extend upward from the floor. The apparatus 10 includes a single fixturing frame 30 having an upper member 32, a lower member 34, and a pair of opposed side members 36. A brace member 37 positioned about midway along and extending between the side members 36 provide a bracing means to prevent the door jambs 16 from buckling or bending inward when concrete, grout, or other filler material is used to fill a gap between the door frame 14 and an adjacent wall (not shown). All of these members are connected together to form the integral, rectangular, and generally rigid fixturing frame 30 generally conforming to at least a width wise extending interior portion of the metallic door frame 14 between its jambs 16. Preferably, the fixturing frame 30 has an exterior periphery that defines the desired interior alignment of the metallic door frame 14. The fixturing frame 30 further includes at least one width wise extending bracing member 37 extending between the opposed side members 36.

Figure 3:
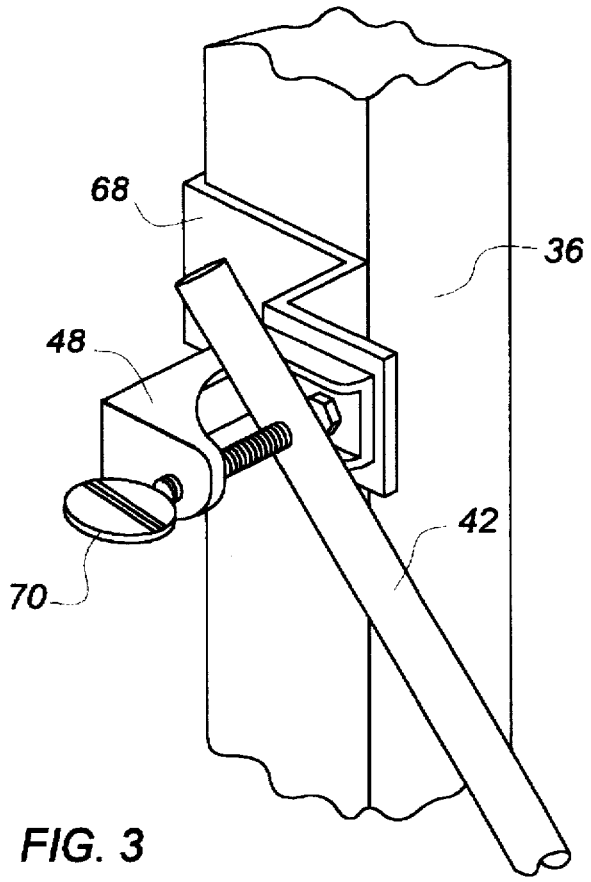
FIG. 3 is a an enlarged view of the clamp in FIG. 1.

Each of two legs 42 (more than two may be used) is pivotally connected to each of the side members 36 allowing for swinging movement of the legs lateral to the plane of the door frame 14. The legs 42 are used to incline the fixturing frame 30 normal to the floor 20 (or at any desired angle) and a fastening means 44 for temporarily securing the fixturing frame to the door frame 14. The fastening means 44 is illustrated as thumbscrews 45 engaging hardware mounting apertures 46 in the door jambs 16 as seen in FIG. 2. The hardware mounting apertures 46 are typically found pre-drilled in the door jambs 16 for mounting door hardware such as hinges at prepared hinge areas 49 and strike plates 51. Additionally referring to FIG. 3, an open ended clamp 48 is pivotably mounted to a bracket 68 attached to each of the side members 36. The clamp 48 has a thumbscrew 70 operable to engage and secure the leg 42 as it lies within the clamp and provides a means for adjusting the length of each of the legs 42 between the side members 36 and the floor 20 in order to locate the legs at a required inclination with respect to the floor as shown in FIG. 1. The legs 42 are preferably constructed from annular conduit which is inexpensive, easily found in most commercial settings and on job sites, and easy to cut to useful lengths.

Figure 4:
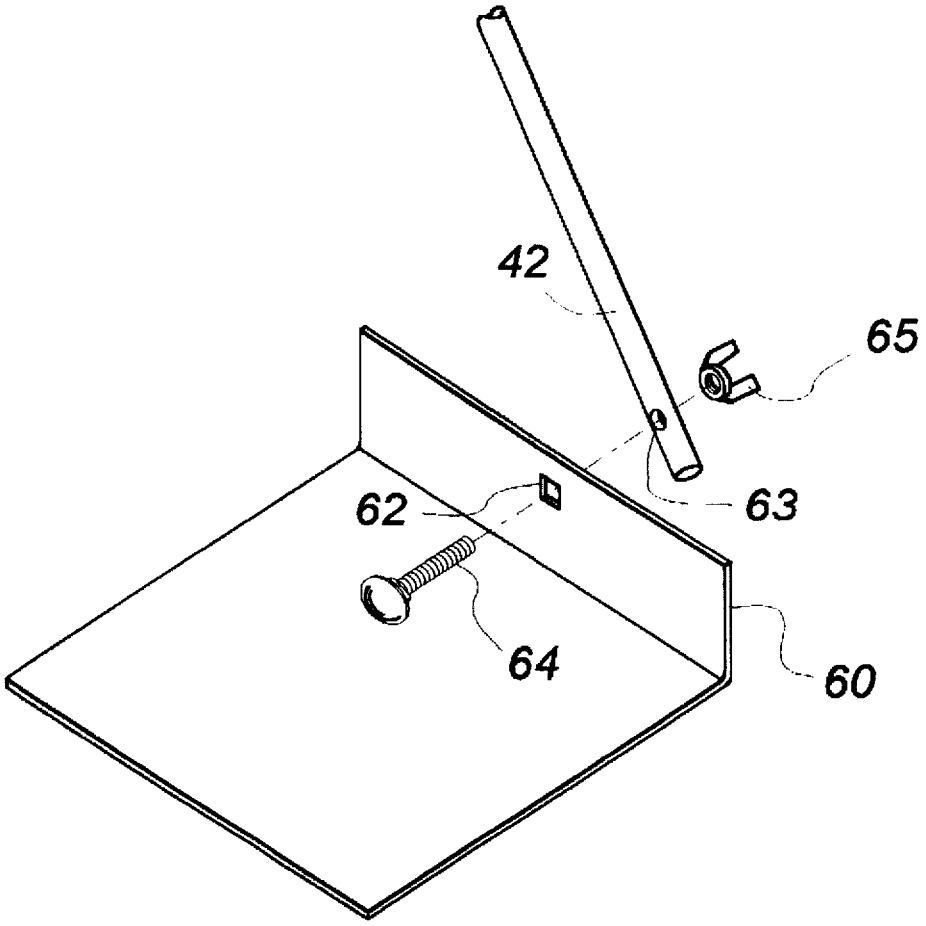
FIG. 4 is a an enlarged view of the support base in FIG. 1.

Referring to FIGS. 1 and 4, a wide flat support base 50 is pivotably attached to a bottom end 53 of each of the legs 42 such that the support base is operable to lie generally flat on the floor 20 and may be secured in place by weights such as masonry blocks 52, shown in phantom, or bags of sand or cement or any weighty material commonly found at a construction site. Square holes 62 are drilled through flanges 60 of the bases 50 and round holes 63 through lower ends of the legs 42 so that carriage bolts 64 may be disposed through the square and round holes to provide a pivoting axis. The carriage bolt 64 is tightened with a wing nut 65 thereby providing a means to secure the bases 50 to the legs 42 in place once an extended length L of the legs and an appropriate angle or position of the legs has been established. The legs 42 are exposed to breakage a great deal more than the shorter smaller bases and associated flanges. Therefore, the square hole 62 is drilled in the flange 60 because if any of the leg 42 are broken and need to be replaced it is easier to drill a round hole on the job site than a square one.

A bent threaded shaft 54, any screw type device will suffice, is disposed through and in threading engagement with a threaded aperture 56 in the lower member 34 and is illustrative of a means for adjusting the height of the fixturing frame 30 above the floor 20. Levels 90 are provided on each end of the brace member 37. Round levels are preferred so that the fixturing frame 30 and the door frame 14 to which it is attached may be accurately and efficiently positioned relative to the walls and floor 20.

While the preferred embodiment of the present invention has been described fully in order to explain its principles, it is understood that various modifications or alterations may be made to the preferred embodiment without departing from the scope of the invention as set forth in the appended claims.

I claim:

1. An apparatus for fixturing and bracing a metallic door frame having two opposed jambs and a connecting header above a floor defining a generally rectangular interior, said apparatus comprising;

a single fixturing frame having an upper member, a lower member, and a pair of opposed side members, said members being connected together to form an integral rectangular fixturing frame adapted to conform to at least a portion of the interior of the metallic door frame, at least one brace member extending between said opposed side members, legs, each of which is pivotally connected to one of said side members by a clamp to allow swinging movement laterally to a plane of said fixturing frame, a fastening means for temporarily securing said fixturing frame to the door frame, and a leg length adjusting means adjusting a length of each of said legs between said side members and the floor to locate said legs at an inclination with respect to the floor, said leg length adjusting means comprising said clamp pivotally mounted to each of said side members.

2. An apparatus as claimed in claim 3 wherein said leg length adjusting means comprises an open ended clamp.

3. An apparatus as claimed in claim 1 wherein said legs are constructed of lengths of conduit.

4. An apparatus as claimed in claim 3 wherein said conduit is annular.

5. An apparatus as claimed in claim 1, further comprising flat support bases each one of which is pivotably attached to a bottom end of one of said legs such that each of said support bases is operable to lie generally flat on the floor.

6. An apparatus as claimed in claim 2 wherein further comprising a height adjustment means for adjusting a height of the fixturing frame above the floor having a threaded shaft disposed through and in threading engagement with a threaded aperture in said lower member.

7. An apparatus as claimed in claim 6 wherein further comprising flat support bases each one of which is pivotably attached to a bottom end of one of said legs such that each of said support bases is operable to lie generally flat on the floor.

8. An apparatus as claimed in claim 7 wherein said legs are constructed of lengths of annular conduit.

9. An apparatus as claimed in claim 8 wherein said fastening means comprises a first screw means for engaging apertures in the door jambs.

10. An apparatus as claimed in claim 7 wherein said flat support base has a right angle flange which is pivotably attached to said bottom end of said leg by a carriage bolt and wing nut.

* * * * *